United States Patent [19]

Green et al.

[11] Patent Number: 5,002,688

[45] Date of Patent: Mar. 26, 1991

[54] DETERGENT LIQUID PROCESSING

[75] Inventors: Robin J. Green, Voorschoten; Johannes C. Van De Pas, Vlaardingen, both of Netherlands

[73] Assignee: Lever Brothers Company, Division of CONOPCO, Inc., New York, N.Y.

[21] Appl. No.: 506,488

[22] Filed: Mar. 30, 1990

Related U.S. Application Data

[63] Continuation of Ser. No. 338,498, Apr. 13, 1989, abandoned, which is a continuation of Ser. No. 192,422, May 10, 1988, abandoned.

[30] Foreign Application Priority Data

May 11, 1987 [GB] United Kingdom ..... 8711060

[51] Int. Cl.[5] ..... C11D 7/14

[52] U.S. Cl. ..... 252/174.25; 252/135; 252/173

[58] Field of Search ..... 252/8.6, 8.7, 131, 160, 252/135, 173, 174.25

[56] References Cited

U.S. PATENT DOCUMENTS 4,469,605 9/1984 Ramachandran et al. ..... 252/8.6
4,618,446 10/1986 Haslop et al. ..... 252/174.25
4,642,198 2/1987 Humphreys et al. ..... 252/136

FOREIGN PATENT DOCUMENTS 0038101 10/1981 European Pat. Off. .
0079646 5/1983 European Pat. Off. .
2170235 7/1986 United Kingdom .
2170235 7/1986 United Kingdom .
2170235 7/1986 United Kingdom .

*Primary Examiner*—Paul Lieberman
*Assistant Examiner*—Alexander G. Ghyka
*Attorney, Agent, or Firm*—Ronald A. Koatz

[57] ABSTRACT

Aqueous liquid detergent compositions containing fabric softening clay material are prepared without an unacceptable viscosity rise occurring either before, during or after incorporation of the clay, by the steps of:

(i) admixture with an aqueous base, of detergent active material and electrolyte, in quantities sufficient to form a low-viscosity system, comprising an active structured lamellar phase dispersed in an aqueous phase; and (ii) subsequently admixing therewith, the fabric softening clay material;

some electrolyte also being pre-mixed dry with the clay.

4 Claims, No Drawings

DETERGENT LIQUID PROCESSING

This is a continuation application of Ser. No. 338,498, filed Apr. 13, 1989, which is a continuation of Ser. No. 192,422 filed May 10, 1988.

The invention relates to a process for preparing a liquid detergent composition, in particular to a liquid detergent composition for washing fabrics and imparting a softness thereto.

Our European Patent Application published under No. EP-A-225 142 describes an aqueous built fabric softening heavy duty liquid detergent which contains a low-swelling clay as a fabric softening material. A number of specific builder salts and clays are suggested for use. The low-swelling clays are chosen to avoid significant increase in product viscosity by virtue of their incorporation, especially in compositions which exist as structured liquids. This is important because too low a viscosity can result in long term product instability when the product contains undissolved material in suspension, whereas too high a viscosity makes product processing and use by the consumer difficult.

The aforementioned co-pending application further teaches that when preparing such compositions, the order of addition of components is important to avoid unwanted increases in viscosity. It is stated that preferably, at least a proportion of the builder should be added to water prior to addition of the clay. This process is claimed per se, including in respect of medium- and high-swelling clays. However, it is also mentioned that when both detergent active and builder are added first, the product may already have a high viscosity, rendering incorporation of the clay difficult without aeration. The latter procedure could result in a product with lower than desired density.

According to GB patent specifications 2 170 235 A; 2 168 717 A and 2 132 629 A, certain liquid detergents are prepared by admixture of electrolyte and surfactants prior to addition of clay.

We have now discovered that in fact, pre-addition of the detergent active and builder (or indeed any other electrolyte) can be effected without an unacceptable rise in viscosity, whilst still preventing the clay from substantial swelling, if the actives and some of the electrolyte are added in amounts such as to form a low viscosity lamellar phase and the clay is then incorporated pre-mixed dry with at least some of the remaining electrolyte.

Thus, the present invention provides a process for preparing an aqueous liquid detergent composition, comprising the steps of:

(i) admixture with an aqueous base of detergent active material and electrolyte, in quantities sufficient to form a low-viscosity system, comprising an active structured lamellar phase dispersed in an aqueous phase; and (ii) subsequently admixing therewith, a fabric softening clay material pre-mixed dry with electrolyte.

However, it must be noted that step (i) in the process of the present invention, is only one stage in the manufacture of the final product, which may or may not itself be active-structured, according to what other components (including the clay) are incorporated, and in what order.

For avoidance of doubt, in any process according to the present invention, where more than one component is incorporated in a single step, for example the aqueous base, detergent active material and electrolyte in step (i) above, each such component may be incorporated sequentially or simultaneously with one or more others, and in any desired order within that step Generally, it is preferred that the aqueous base in step (i) comprises substantially only water, but this does not preclude the presence of other ingredients (except for those recited in steps (i) and (ii)). Also, this does not preclude addition of a further amount of aqueous base, different from, or identical to that recited in step (i) at any other stage in the process.

The electrolyte can be selected from one or more electrolyte materials which are ionisable in aqueous solution and may be builders, non-builders or mixtures of both. Examples of suitable builders and non-builders are elaborated hereinbelow.

The electrolyte used to form the lamellar phase and that pre-mixed dry with the clay can be the same or different and each independently may be one, or a mixture of electrolytes.

Often, the amount of electrolyte pre-mixed dry with the clay will be from 0.5% to 20% by weight of the total electrolyte in the final composition, typically from 3% to 10%, for example around 5%. It is also possible to incorporate some electrolyte at any other stage in the process although most preferably, substantially all of the electrolyte is incorporated in the lamellar phase-forming and pre-drymixing steps.

The various kinds of active structuring which can be achieved in step (i) are described in, for example, H A Barnes, Detergents Ch.2 in K. Walters (Ed), Rheometry:Industrial Applications, J. Wiley & Sons, Letchworth, 1980. Techniques for achieving low-viscosity active structured phases are described in many references in patent and other literature, for example, our European patent specifications EP-A-38,101 and EP-A-79,646.

The amounts and types of electrolytes and surfactants required to form the lamellar phase will thus readily be apparent to those skilled in the art. The presence of such a lamellar phase in a mixture can be detected by various known means, for example optical techniques, rheometrical measurements, x-ray or neutron diffraction and electron microscopy.

The fabric softening clays may be classed as low, medium or high swelling. For the purposes of the present invention, the following definitions apply. The low swelling types (substantially as used in compositions described in our aforementioned unpublished specification) are those having a swellability (determined as herein described) in an 8% sodium tripolyphosphate solution of less than 25%

The medium swelling types are those having a swellability in an 8% sodium tripolyphosphate solution of from 25% to 75%

The high swelling clays are those having a swellability in an 8% sodium tripolyphosphate solution of greater than 75%.

The swelling behaviour of the clays is quantified by the following test.

A dispersion is prepared at room temperature containing 435g of water, 40g sodium tripolyphosphate and 25g of clay material (the sodium tripolyphosphate is completely dissolved in the water before the addition of the clay).

The dispersion is stirred for 5 minutes with a magnetic stirrer and then placed in a 1000 ml measuring cylinder. The dispersion is then left to stand, undisturbed for two weeks. After this time the dispersion is examined. Generally some separation will have occurred. A lower layer of dispersion or gel containing the clay will be visibly distinguishable from a relatively clear upper layer. The height of the lower layer (h) and the overall height of the total liquid (H) are determined and percentage swellability (S) is calculated using the expression $$S = \frac{h}{H} \times 100$$

The following Table classifies a number of typical fabric softening clays according to this rule:

TABLE

| TRADE NAME | CLAY TYPE | S(%) | SWELLING CLASS |
|---|---|---|---|
| CLARSOL KCl | Ca Bentonite | 86 | HIGH |
| MDO 77/84 | | 73 | MEDIUM |
| CLARSOL KC2 | Ca Bentonite* | 68 | MEDIUM |
| STEETLEY NO 1 | white | 14 | LOW |
| STEETLEY NO 2 | bentonite | 20 | LOW |

*activated with $Na_2CO_3$

The level of fabric softening clay material in the product is preferably at least 1% by weight, but not more than 10% by weight. A most preferred level is from 3% to 7% by weight.

We have found that the present invention can be performed with electrolytes which are either builder salts or which are non-peptising/non-building electrolytes (hereafter termed NPNB's). Examples of builder salts are given further below.

The NPNB's are those electrolytes which have the property of preventing peptisation (and hence swelling) of the clay by any peptising electrolyte and/or detergent active which may be present in the formulation. This is useful because it is the swelling which causes a viscosity increase and that is what the present invention seeks to reduce. Here it must be mentioned that we believe that knowledge of the link between swelling and viscosity is not presently in the public domain and will not be until publication of our aforementioned co-pending application. The peptising phenomenon is one which can be determined by experiment.

One suitable methodology for this determination is using a medium- to high-swelling natural sodium bentonite. This is preferred over calcium bentonite, which could result in deviating initial effects being observed on first addition of the electrolyte under test. This effect may be due to ion-exchange and consequent transformation of the calcium clay to the sodium (or other relevant cation) form. For each test composition, the chosen amount of electrolyte is first added with stirring to water, followed by the clay. The amount of clay is determined by prior experiment (as hereinbefore described) as that resulting in a swellability (S) of the sodium bentonite in water of about 75% After addition of the clay to the present test composition, the swellability (S) is again tested.

A peptising electrolyte will exhibit an increase in swellability up to moderate electrolyte concentrations, whereas a non-peptising electrolyte will show a decrease in swellability, even at relatively low concentrations.

Thus, by way of Example, FIG. 1 shows a plot of the swellability of a high-swelling natural sodium bentonite (Clarsol W100) in water, as a function of clay concentration. From this, a clay concentration of 1.5% by weight is chosen as corresponding to a swellability of about 75%. The swellability of this amount of clay is plotted as a function of the concentration of a dissolved electrolyte under consideration. A typical result is shown in FIG. 2, the clay and its concentration being those derived from FIG. 1. It can be seen that with sodium tripolyphosphate (STP) and sodium citrate, there is first an increase, then a decrease in swellability of the clay, with increasing electrolyte concentration and so by the present definition, these are peptising electrolytes. On the other hand, with sodium chloride and sodium formate, an immediate and marked decrease in swellability is seen as electrolyte concentration is increased from zero. Thus, the latter two are non-peptising electrolytes.

Thus, as stated, even if demonstrating at least some non-peptising properties, the NPNB's are not those electrolytes which are known as calcium ion sequestrant and/or precipitant builders, such as the various alkali metal carbonates, bicarbonates, phosphates, silicates, borates etc. These are already known as ingredients in clay containing liquid detergents. What is surprising in the present invention is that other electrolytes can be used and they mitigate the swelling induced viscosity increase when incorporated in amounts which are low relative to the proportions in which builder salts are commonly used. It should also be noted that the definition of NPNB's also excludes those salts which are usually employed for purposed other than building but which are known to have subsidiary builder properties, or are converted to builders in the wash solution. One example of such material is sodium perborate bleach.

By inhibiting the swelling of the clay, the NPNB's limit the resultant viscosity increase of the composition. For the avoidance of doubt, viscosity increase means the viscosity rise substantially immediate upon introduction of the clay in the manufacturing process and it also refers to a clay swelling induced rise in viscosity on standing or during storage. It does not encompass any viscosity increase due to progressive ordering in any active structuring phase which also may be present.

The NPNB's do not in general totally negate the viscosity rise due to the clay but they are certainly capable of reducing it to an acceptable level. As a rule, they are incorporated in amounts such as to limit the clay swelling (by the test hereinbefore described) to no more than 45%, preferably 35%, especially 25%. To achieve this, it is normally necessary for them to be present from about 0.5 to about 10% by weight of the total composition, typically from about 1 to 5%, even from about 1.5 to 2%.

The use of NPNB's in clay containing compositions is especially useful when an active structuring phase is also present to suspend solid builder particles although non-active-structured systems are also within the ambit of the present invention. In such compositions, most if not all of the NPNB will be in solution in the aqueous phase, which may contain other dissolved electrolyte material such as builder salts. It is well known that care must be taken in formulating and manufacturing active structured systems in order to avoid increase of viscosity to an unacceptable level. This problem is exacerbated when clay is present and the NPNB's help to mitigate this effect. In such structured compositions, the total composition should be formulated so as to resist phase separation on standing. Examples of active structured systems are described in our European patent specification EP-A-38,101.

The NPNB's may be selected from a very wide range of organic and inorganic salts of metals, preferably alkali metals, for example formates, acetates, halides (such as chloride) and sulphate. The potassium, and especially sodium salts are preferred.

The detergent compositions of the present invention necessarily contain one or more detergent active materials.

The detergent compounds may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium $C_6$–$C_{18}$) alkyl sulphates.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, ie 5 to 25 units of ethylene oxide per molecule, the condensation products of aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

Mixtures of detergent active materials may be used. In particular, we prefer a mixture of an anionic detergent active and a nonionic detergent active. Especially when the product is in the form of a structured liquid, soap may also be present.

Where the detergent active material is soap, this is preferably selected from alkali metal salts of fatty acids having 12 to 18 carbon atoms. Typical such fatty acids are oleic acid, ricinoleic acid, and fatty acids derived from castor oil, rapeseed oil, groundnut oil, coconut oil, palmkernel oil or mixtures thereof. The sodium or potassium salts of these acids can be used.

The level of detergent active material in the product is preferably at least 2% by weight, but not more than 45% by weight, most preferably from 6% to 15% by weight.

As well as NPNB's, electrolytes used in the process of the present invention, or added at a later stage in manufacture, include detergency builder materials to reduce the level of free calcium ions in the wash liquor and thereby improve detergency. This material may be selected from precipitating detergency builder materials such as alkali metal carbonates and ortho-phosphates, ion-exchange builder materials such as alkali metal aluminosilicates and sequestering builder materials such as alkali metal tripolyphosphates, citrates and nitrilotriacetates. Particularly preferred is sodium tripolyphosphate for reasons of product structure and building efficiency. At least 5% by weight of the detergency builder material is required to provide a noticeable effect upon detergency.

In the case of liquids which are not active-structured, the amount of detergency builder material will be within a range which is effective under the intended wash conditions, including taking into account the relevant water hardness, yet which will be soluble in the composition at about room temperature (say 20° C). Typically this will be in the range of from 5 to 15% by weight, based on the weight of the product, although the amount which can be dissolved in the composition will depend on whether other electrolytes are also present. Thus, for example, the aforementioned weight range will be reduced when glycerol/borax is also present as an enzyme stabliser.

In the case of active-structured liquids it is preferred that the level of detergency builder material in the product is more than would dissolve at 20° C. In the case of sodium tripolyphosphate, a preferred level is from 22 to 35% by weight, based on the weight of the product.

The liquid detergent composition of the invention may further contain any of the adjuncts normally used in fabric washing detergent compositions, eg sequestering agents such as ethylenediamine tetraacetate; buffering agents such as alkali silicates; soil suspending and anti-redepositon agents such as sodium carboxymethyl cellulose and polyvinylpyrrolidone; fluorescent agents; perfumes; germicides; and colourants.

Further, the addition of lather depressors such as silicones, and enzymes, particularly proteolytic and amylolytic enzymes; and peroxygen bleaches, such as sodium perborate and potassium dichlorocyanurate, including bleach activators, such as N,N,N',N',- tetraacetyl ethylene diamine, may be useful to formulate a complete heavy duty detergent composition suitable for use in washing machines.

Also particularly beneficial are agents for improving the thermal stability of the product, such as sodium toluene sulphonate, xylene sulphonate or cumene sulphonate, at levels of up to 1% by weight, such as from 0.4% to 0.5%.

One example of a preferred method of effecting the process of the present invention is to make first, an aqueous mix of the detergent active material and electrolyte, in quantities sufficient to form a low viscosity system, comprising an active structured lamellar phase dispersed in any aqueous phase. Finally, the clay material is added and dispersed with stirring, until a homogeneous mass is obtained.

The mixture is then cooled under constant agitation and water is added, if necessary, to compensate evaporation loss. Thereafter perfume may be added when the product is at substantially ambient temperature.

In some cases we prefer for a small quantity of the total electrolyte to be pre-mixed dry with the clay, which may result in a further decrease of product viscosity.

The compositions of the invention should have a viscosity of less than 3000, preferably less than 1500 cPs measured at 20° C and at a shear rate of 21 $sec^{-1}$. Most preferably the viscosity is between 650 and 850 cPs. Viscosities below 650 cPs can result in a loss of product stability.

The invention will now be illustrated by the following example.

The following formulation is the basis for this Example (all quantities % w/w).

| | |
|---|---|
| Water | 52.15 |
| *Clay | 5 |
| LAS-acid | 7 |
| Synperonic A7 | 3 |
| NaOH | 0.85 |
| Glycerol | 5 |
| Borax | 3.5 |
| STP-NW | 22 |

-continued

| | |
|---|---|
| Sodium Carbonate | 1.5 |

*Clarsol KC2, a medium swelling clay

* Clarsol KC2, a medium swelling clay

This was made up with the following preparative order.

Preparation A —Clay added to water at beginning of process before incorporation of other ingredients.

Preparation B —Clay added to total composition as last ingredient.

Preparation C —As B but with the 1.5% of the sodium carbonate pre-mixed dry with the clay.

The viscosities (mPas at $21s^{-1}$) were measured at one day and one month, after preparation. The results are presented in the Table.

TABLE

| | (Viscosity (mPas) at $21s^{-1}$) | |
|---|---|---|
| Prep | 1 day | 1 month |
| A | 1660 | 1570 |
| B | 1570 | 1380 |
| C | 1490 | 1060 |

The results demonstrate a reduction in viscosity when the clay is incorporated after the actives and substantially all of the electrolyte. A further viscosity reduction is apparent when some of the electrolyte is dry mixed with the clay, prior to addition.

We claim:

1. A process for preparing an aqueous liquid detergent composition, comprising the steps of:

(i) admixing with an aqueous base, of detergent active material and electrolyte, in quantities sufficient to form a low-viscosity system, comprising an active structured lamellar phase dispersed in an aqueous phase; and (ii) subsequently admixing therewith, a fabric softening clay material;

wherein from 0.5 to 201% by weight of the total electrolyte in the final composition is pre-mixed dry with the clay material.

2. A process according to claim 1, wherein the clay is a low-swelling clay having a swellability in an 8% sodium tripolyphosphate solution of less than 25%.

3. A process according to claim 1, wherein the electrolyte in the final composition comprises a builder salt.

4. A process according to claim 1 wherein the electrolyte in the final composition comprises a non-peptising/non-building electrolyte.

* * * * *